United States Patent [19]

Heyer et al.

[11] 4,080,198

[45] Mar. 21, 1978

[54] EROSION AND CORROSION RESISTANT ALLOYS CONTAINING CHROMIUM, NICKEL AND MOLYBDENUM

[75] Inventors: Bruce A. Heyer; Howard S. Avery, both of Mahwah, N.J.

[73] Assignee: Abex Corporation, New York, N.Y.

[21] Appl. No.: 771,656

[22] Filed: Feb. 24, 1977

[51] Int. Cl.[2] ..... C22C 37/03

[52] U.S. Cl. ..... 75/125; 75/128 D; 75/128 W; 148/35

[58] Field of Search ..... 75/125, 128 D, 128 W; 148/35

[56] References Cited

U.S. PATENT DOCUMENTS

| | | | |
|---|---|---|---|
| 3,165,400 | 1/1965 | Roy et al. | 75/128 D |
| 3,235,417 | 2/1966 | Roy et al. | 75/128 D |
| 3,334,996 | 8/1967 | Foster et al. | 148/35 |
| 3,961,994 | 6/1976 | Thome | 148/35 |

FOREIGN PATENT DOCUMENTS

| | | | |
|---|---|---|---|
| 46-26214 | 7/1971 | Japan | 75/128 D |
| 6,917,161 | 9/1969 | Netherlands | 75/128 D |

*Primary Examiner*—Arthur J. Steiner
*Attorney, Agent, or Firm*—Kinzer, Plyer, Dorn & McEachran

[57] ABSTRACT

A cast iron alloy of about (% by weight) 1.6 carbon, 2 nickel, 2 molybdenum, 28 chromium and up to 1 copper, balance iron, and characterized by chromium and molybdenum carbides dispersed in an austenitic matrix.

2 Claims, No Drawings

EROSION AND CORROSION RESISTANT ALLOYS CONTAINING CHROMIUM, NICKEL AND MOLYBDENUM

This invention relates to ferrous metal castings resistant to the simultaneous action of abrasive wear and chemical attack.

Abrasion resistant cast irons are well known, in many forms, but a cast iron resistant to wear is not necessarily resistant to chemical corrosion. When pumping a slurry containing hard gritty particles in suspension, for example, the pump parts may be quite resistant to wear but when that same slurry exhibits a pH of say three (mildly acid) rather than seven (neutral) the pump parts may fail quickly because of acid attack. Indeed we encountered that very problem, giving rise to the present invention characterized by pump vanes, impellers, housings and other parts cast from a ferrous metal alloy consisting essentially of about 1.6% carbon, 28% chromium, 2% nickel, 2% molybdenum, 1% copper, the balance iron except for impurities or tramp elements (manganese, silicon, sulfur and phosphorus); also the alloy is susceptible to so-called microalloying (up to 1%) of titanium, boron, zirconium, niobium, rare earth elements, and so on.

We were concerned with trials of an (herein H25) abrasion resistant alloy deemed superior for resistance to low stress scratching abrasion and erosion in neutral (pH 6.8–7.2) solutions. It has enjoyed a high degree of commercial success in the slurry pump market where metal loss by erosion is the significant life factor for impellers, pump housings and so on. However, when subjected to an acidic corrosive environment, e.g. pH3, the known alloy displaced some lack of corrosion resistance, which could eventually account for high metal loss rates and short life.

The corrosion resistant alloys like CF8M (cast equivalent of 316 Stainless) enjoy virtual immunity to corrosion in acidic solutions at pH3. However, when tried in the presence of an abrasive and high velocity impingement, they are subject to rapid metal loss by erosion.

The alloy of the present invention is intended to fill the gap between the abrasion and corrosion resistant alloys and provide a material with adequate resistance to corrosion at pH3 while maintaining a high degree of resistance to abrasive wear.

Specifically, a typical application would be in wet $SO_2$ scrubbers or similar fluid handling equipment, in which excursions from pH6.0 to pH3 are to be expected in the operation of the pumps, and in which small quantities of abrasives such as alumina, sand, or other particles are suspended in the fluids. CF8M erodes rapidly at impeller tips and other high velocity areas in the pump system. The alloy of the present invention can be expected to outlast the two mentioned above because of its combined resistance to mild corrosion and severe erosion.

The concept of the present alloy was arrived at through the following rationale, beginning with, as the basis for comparison, the alloy mentioned above as having superior resistance to abrasion;

(1) Lower the carbon to release additional chromium to the matrix for improved corrosion resistance;

(2) Add nickel, an austenite stabilizing element, to offset the ferrite-forming reduction of carbon;

(3) Add molybdenum for resistance to chloride attack and to release even more chromium to the matrix by substitution of Mo for Cr in the carbide.

The alloy may contain up to 1% copper which would serve as an aid in austenite stabilization and precipitation hardening.

Several heats of varying compositions were made and evaluated on the basis of response to heat treatment and on microstructure. The alloy of the invention provided the desired combination of these factors. Subsequent testing in a spinning-disc erosion-corrosion test machine confirmed its superiority to both of the known alloys in a pH2.5 ($H_2SO_4$) solution containing twenty volume percent alumina as the abrasive.

Manganese, silicon, sulfur, phosphorous, etc. appear at levels typical of cast alloys. Additions of active elements such as titanium, zirconium, boron, niobium, rare earth elements, etc. in amounts up to about 1% (each) alone or in combination may prove to be beneficial to erosion-corrosion resistance and other properties.

The alloy is typically about HB400 as cast and can be hardened to near HB600 or any hardness between HB400 and HB600 by a simple aging treatment at a temperature between 600° F (316° C) and 1800° F (982° C). It is machineable in the "as cast" condition. A high-temperature heat treatment (2100° F) can be utilized to resolutionize the alloy to a hardness of about HB400, after which it can again be aged to the desired hardness.

The preferred alloy, emerging after testing is, in percent by weight:

C — 1.6
Cr — 28
Mo — 2
Ni — 2
Cu — up to 1
Fe — balance, substantially (as noted)

The microstructure of the alloy consists of massive, interdendritic chromium carbide in a basically tough or non-brittle austenitic matrix. Precipitated carbides (chromium and molybdenum) appear in the matrix in a size and quantity that is dependent upon aging temperature.

Special microalloying elements and heat treatments produce constituents in the microstructure that have not been fully identified.

Set forth below are performance data comparing the present alloy to the two known alloys (H25 and CF8M) in several different environments where an alumina slurry is the erosive medium, and either various pH values or saline solutions represent the corrosive one. The present alloy is the most impressive at pH 2.5; it also performs well in a less hostile saline environment (where the H25 alloy would be preferred) and displays superior performance to the stainless grade CF8M which shows superiority only in an extremely low pH environment:

EROSION-CORROSION IN ALUMINA SLURRIES
Mils per Year Wear*

| Environment | Alloy H25 | Alloy Present | Alloy CF8M |
|---|---|---|---|
| 20 v/o $Al_2O_3$ Slurry (pH7) | 9.2 | 12.5 | 68.5 |
| 2.5 w/o NaCl + 20 v/o $Al_2O_3$ Slurry | 7.7 | 14.2 | 84.4 |
| 2.5 v/o $H_2SO_4$ + 20 v/o $Al_2O_3$ Slurry | 5790 | 2070 | 138 |
| pH 2.5 ($H_2SO_4$) + 20 v/o $Al_2O_3$ Slurry | 3770 | 75.0 | 159.3 |
| pH11 (NaOH) + | 8.4 | 11.3 | 77.2 |

-continued

EROSION-CORROSION IN ALUMINA SLURRIES
Mils per Year Wear*

| Environment | Alloy H25 | Alloy Present | Alloy CF8M |
|---|---|---|---|
| 20 v/o $Al_2O_3$ Slurry | | | |

*As measured in an Erosion-Corrosion test machine on a sample alloy disc rotating at a peripheral velocity of 29.67 ft/sec. during a 95-hour test period.

We claim:

1. A ferrous metal casting which is resistant to the combined action of abrasive wear and chemical corrosion, capable of being microalloyed with an element selected from the group consisting of titanium, zirconium, boron, niobium and rare earth elements in an amount up to about one percent, each, and consisting essentially of carbon about 1.6%, chromium about 28%, nickel about 2%, molybdenum about 2%, copper up to about 1%, balance substantially all iron except for impurities and tramp elements and said alloy being characterized by chromium and molybdenum carbides dispersed in a substantially austenitic matrix.

2. A casting according to claim 1 which is a fluid handling pump part.

* * * * *